United States Patent [19]

Wassell

[11] Patent Number: 4,712,761

[45] Date of Patent: Dec. 15, 1987

[54] PICTURE WALL HANGING ASSEMBLY

[76] Inventor: Edward T. Wassell, 3540 Ketch Ave., Oxnard, Calif. 93033

[21] Appl. No.: 8,565

[22] Filed: Jan. 29, 1987

[51] Int. Cl.[4] ..... A47G 1/16

[52] U.S. Cl. ..... 248/475.1; 340/152.1; 248/220.1; 248/489

[58] Field of Search ..... 248/475.1, 467, 466, 248/489, 220.1, 220.2; 40/152.1

[56] References Cited

U.S. PATENT DOCUMENTS

| | | | |
|---|---|---|---|
| 1,908,200 | 5/1933 | Webster | 248/495 |
| 2,872,140 | 2/1959 | Zareko | 248/470 |
| 3,256,630 | 6/1966 | Spector | 40/152.1 |
| 3,294,355 | 12/1966 | Topf | 248/467 |
| 3,965,600 | 6/1976 | Paskerian | 248/489 |
| 4,228,982 | 10/1980 | Sellera | 248/475.1 X |
| 4,277,903 | 7/1981 | Crossot | 40/152.1 |
| 4,385,744 | 5/1983 | Sherman et al. | 248/551 |
| 4,420,138 | 12/1983 | Sobel | 248/496 |
| 4,422,613 | 12/1983 | Cray et al. | 248/473 |
| 4,458,873 | 7/1984 | Sutherland | 248/544 |
| 4,459,773 | 7/1984 | Sandlin et al. | 40/155 |
| 4,530,482 | 7/1985 | Berinson | 248/475.1 |
| 4,557,457 | 12/1985 | Cockfield et al. | 248/544 |
| 4,571,866 | 2/1986 | Cole et al. | 40/152.1 |
| 4,606,526 | 8/1986 | Rabinowitz | 248/475.1 |
| 4,611,780 | 9/1986 | Robertson | 40/152.1 |

*Primary Examiner*—Ramon O. Ramirez

*Attorney, Agent, or Firm*—Kenneth J. Hovet

[57] ABSTRACT

A picture frame corner bracket is provided with a downwardly extending flange for parallel engagement with a trough that extends from an elongated wall mounting strip. The bracket includes an upper straight edge extending to a square upper corner that permit a self-alignment and accurate securement to each upper corner of a picture frame. The flange of the bracket is disposed parallel with the upper edge so that when the bracket is engaged with the wall strip, the picture frame will automatically assume the same alignment as the wall strip.

16 Claims, 5 Drawing Figures

PICTURE WALL HANGING ASSEMBLY

BACKGROUND OF THE INVENTION

1. Field of the Invention

The invention relates to systems for hanging articles on walls and, more particularly, to a corner bracket-wall strip picture hanging assembly.

2. Description of the Prior Art

A common problem in hanging pictures on walls is to secure the picture in a horizontal manner. The wire and nail approach is unstable and requires frequent adjustment. If the nail is mounted only into plaster, it can become loose and perhaps become pulled out. Also, the nailhead must be large, relative to the wire diameter, to avoid disengagement of the wire over the nailhead.

Improvements to the above involve the use of wall hooks which are nailed to the wall. The hooks provide a more reliable connection with the picture frame wire. However, the picture still relies on the security of one or two nails that hold the hooks.

An additional problem inherent with the above approaches is the careful measurements that must be made to insure the wire ends are attached to the picture frame at exact opposing points. If the attachment points are just slightly off, the picture will hang crooked. It is also difficult to determine the precise length of wire to use. If too much is used, the picture will hang too low and expose the wall nails or hooks.

A still further inherent disadvantage of the above systems concerns the ability to hang multiple pictures at the same level. Such an arrangement is often desired for aesthetic reasons. With the wall nail or hook approach, it is exceedingly difficult and tedious to align a plurality of picture frames along the same horizontal plane. This is especially true when the frames have different sizes.

An attempt to obviate the above problem is shown in U.S. Pat. No. 1,908,200 to Webster. This patent describes breakaway channel-like strips which are interchangeable for mounting on a picture or a wall. The wall strips can be readily mounted horizontally and one or more pictures can be hung therefrom—presumably in horizontal alignment. However, difficulty arises because the corresponding picture strips themselves must be mounted on the pictures in a precise horizontal position. Accomplishing this additional step is troublesome and great care must be exercised in making the correct measurements on each and every picture.

Also, with Webster's system, engagement occurs between the lower channel of the wall strip and the upper channel of the corresponding picture strip. This creates a large gap between the wall and picture and exposes the unsightly strips. It also results in a significant tilt to the picture which may be undesirable.

Further it's possible the upper channel of the picture strip may be mistakenly placed upon the upper (instead of lower) channel of the wall strip. This creates a hazardous unstable condition whereby the picture can readily be dislodged. This could result in personal harm or damage to the picture and environs.

Altering the length of Webster's strips by breaking at the score lines is another disadvantage. In the case of metal, such breaking would be difficult and require additional tools and possibly a vise. Metal distortions would likely occur. Also, fastening holes would be necessary for every segment and this may not even be feasible for use with pictures having only a narrow frame for attachment.

SUMMARY OF THE INVENTION

A picture wall hanging assembly is provided that includes a unique picture frame corner bracket. The bracket cooperates with a wall track for a gravity engagement that is effective, inexpensive and simple to install. The desired elevation and alignment of the picture is insured by placement of the wall track—not by additional measurements and uncertain attachments on the picture frame.

The bracket includes picture frame alignment edges and a lower edge that includes a flange. The flange engages a trough formed in the track for effecting the hanging of the picture frame.

DESCRIPTION OF THE PREFERRED EMBODIMENT

Figure 5:
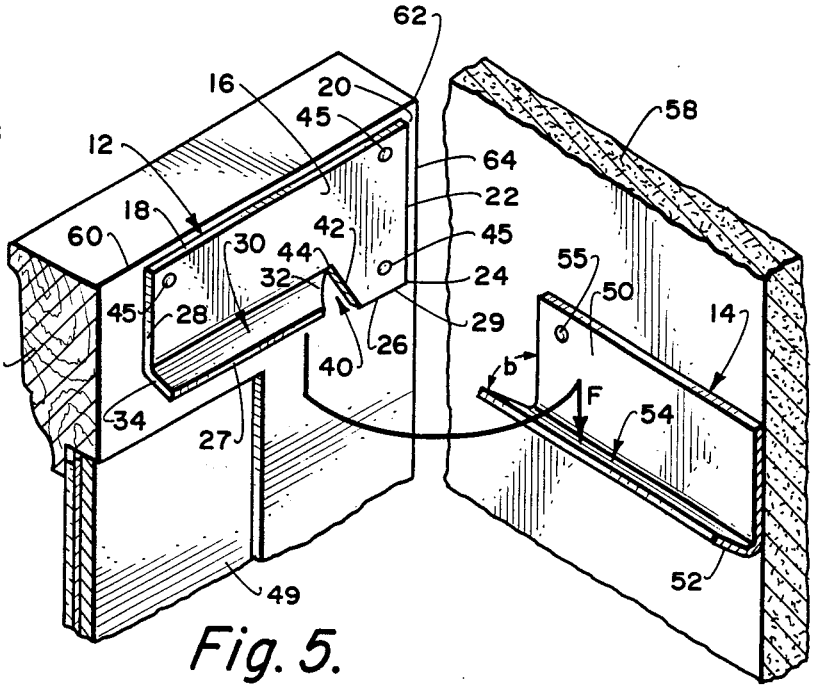
FIG. 5 is a fragmentary perspective view showing the bracket of the invention being engaged with the trough of a wall track.

With reference now to the drawings, FIG. 5 shows the novel bracket 12 of the invention in association with its assembly to wall track 14. The bracket comprises a thin plate of metal or plastic having a flat body portion 16. The body portion is bounded in part by a straight upper edge 18 forming an upper corner 20 with straight outer edge 22. The corner is preferably square for a purpose to be hereinafter described.

The outer edge 22 forms an intersection 24 with lower edge 26. At least a part of the lower edge is flared outwardly and downwardly to form a flange 30. To insure a secure engagement with track 14, the flange should have an angular displacement from the body portion of 130° or greater and a width at least equal to the width of upturned lower end 52 of the track.

The flange is defined by straight lower edge section 27 bounded by first lateral edge 32 and opposing second lateral edge 34. Edge section 27 extends parallel with upper edge 18. It preferably comprises a major portion of the overall length of lower edge 26 for enhanced strength and stability.

As shown, the second lateral edge is most conveniently a continuation of inner edge 28 which intersects with the upper and lower edges to form a completed quadrilateral outline. Preferably, the overal bracket has a rectangular shape.

With further reference to FIG. 5, flange 30 is spaced along the lower edge from intersection 24 by flat section 29 and notch opening 40. The notch opening is defined by inclined edge 42 extending upwardly and angularly into the body portion from lower edge 26. It intersects at an acute angle with the flange first lateral edge to form notch corner 44. The first lateral edge may be convex to enlarge the notch opening.

Figure 1:
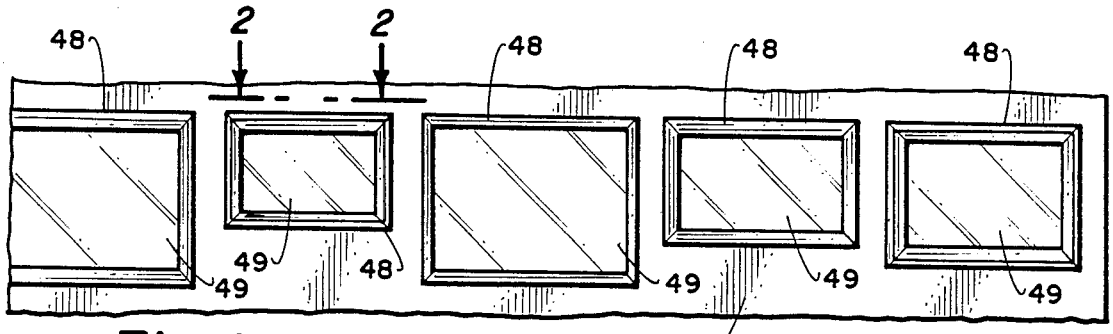
FIG. 1 is a fragmentary elevational view showing use of the invention with multiple picture frames hung on a wall in horizontal alignment.
Figure 2:
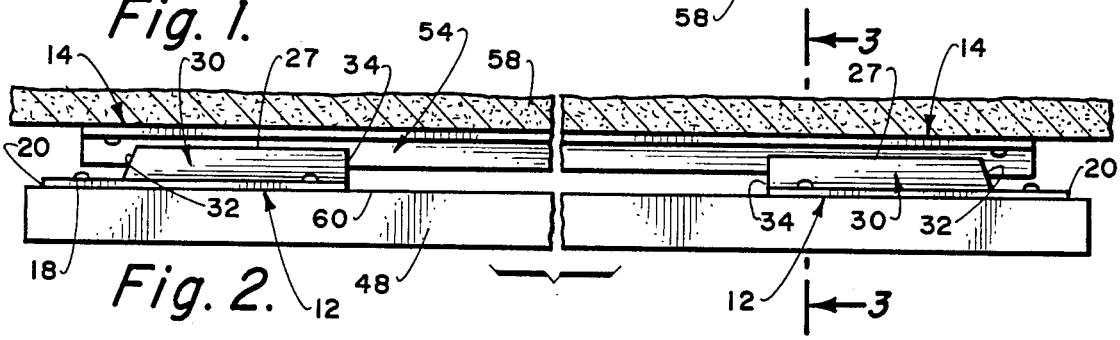
FIG. 2 is a fragmentary partial sectional view taken along lines 2—2 of FIG. 1.
Figure 4:
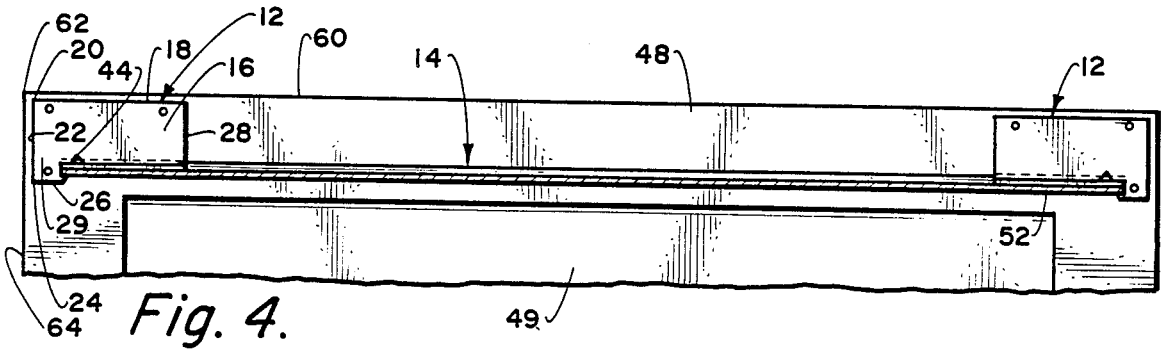
FIG. 4 is a fragmentary elevational view taken along lines 4—4 of FIG. 3.

As shown in FIGS. 1, 2 and 4, the notch opening permits upturned lower end 52 of the track to extend beyond the first lateral edge 32 of flange 30. This is advantageous since any number of pictures with brackets 12 can thereby engage the track at any location along the track length. Another advantage is that the notch opening serves to space-apart lower edge section 27 from nail opening 45. This greatly facilitates use of a hammer when securing nails 46 through nail openings in flat section 29.

The bracket is provided with picture frame attachment means which may include adhesive materials, fusion bonding, cloth fasteners or mechanical means such as screws and nails. As shown, openings 45 extend through the body portion at predetermined locations to allow for insertion of a fastener, shown as nails 46, into picture frame 48.

Wall track 14 is an elongated strip of metal or plastic which has structural integrity and can be shaped in the same manner as bracket 12. It includes a web 50 having a lower end 52 which is turned upwardly and outwardly at an acute angle to form a straight trough 54.

The web is flat and includes wall attachment means for securement to a wall. Such means can comprise any of the items listed as the picture frame attachment means. As shown, openings 55 are provided at spaced-apart locations along the web longitudinal extent for insertion of fasteners, such as nails 46 into wall 58. It is desirable to have the locations coincide with the position of wall framing members (not shown) for enhanced securement.

Figure 3:
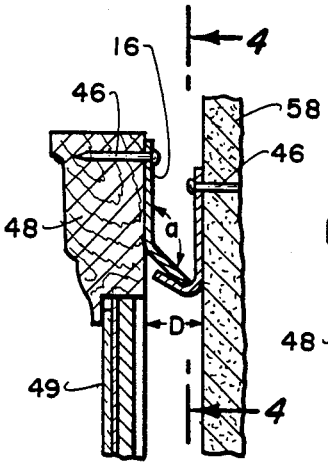
FIG. 3 is a fragmentary sectional view taken along lines 3—3 of FIG. 2.

The width of the upturned lower end 52 is preferably less than the width of flange 30. However, it will be appreciated that the width and angle of both members can be adjusted to minimize the overall spacing D between the wall and picture frame when assembled as shown in FIG. 3. Also, it is desirable that angle b between lower end 52 and web 50 be 180°-complementary to angle a. This allows flange 30 to overlay the lower end in a coextensive manner for a more stable engagement.

In operation, the advantages of the invention become readily apparent. The bracket 12 mounts on the corner of a frame 48 that outlines a picture 49. In the embodiment shown, the upper edge 18 is aligned with the top frame member edge 60. Upper corner 20 is placed adjacent frame corner 62 with outer edge 22 in alignment with frame side member edge 64. The bracket is then secured by insertion of nails 46 through openings 45 into the wood frame 49.

If a metal or plastic picture frame is being used, the bracket 12 may be secured with adhesive materials or fusion bonded. In all cases, the bracket will function to reinforce the corner and strengthen the overall picture frame. Further, it will be noted that no measurements of any sort are required. Still further, if the picture frame is out of square, alignment with the bracket corner and edges provides a simple means of correction. Cumbersome squaring tools and detailed measurements are avoided.

The track 14 is secured to a wall 58 wherever it is desired to hang a picture. Initially, the track may be provided in varying lengths. It should be somewhat less than the width of the picture frame, but sufficiently long to span flange 30 of each opposing upper corner bracket. The track is aligned horizontally at the desired wall location and secured to the wall with nails 46 through openings 55. The openings are preferably spaced-apart to coincide with wall framing members for a more secure attachment. Thereafter, the flange 30 of each opposing corner bracket of a picture frame is juxtaposed upon lower end 52 of the track as shown by arrow F. Lower edge section 27 will slide by gravity into trough 54.

The width of lower end 52 should be sufficient to allow an effective overlap of flange 30 and prevent an easy dislodgement. With the above criteria in mind, the width of either the flange or lower end can otherwise be adjusted to minimize the spacing D between the wall and picture. Such spacing can also be minimized by increasing angle a and/or decreasing angle b. Less spacing helps to obstruct any side view of the bracket and track assembly and also provides for less picture tilt and a more aesthetically pleasing appearance.

If several pictures are to be mounted across a wall as shown in FIG. 1, the invention provides an additional advantage. In such case, multiple tracks can be aligned along the same horizontal line without multiple separate measurements. Additional individual picture frame measurements are avoided with the self-locating corner brackets. Installation of such brackets at each picture frame corner automatically insures a pleasing horizontal alignment of all the pictures when they are mounted upon the tracks.

While the most common application of the invention is with wooden picture frames, the term "picture frame" is intended to encompass plastic or metallic frames; frames for items other than pictures, e.g., textiles, mirrors, shelving and the like; and, square or rectangular shaped solid items such as plaques, game boards and mounts for wall lights and sconces. It will also be understood that the invention contemplates the use of two mirror-image brackets, one for each opposing upper corner of a picture frame. Therefore, all discussion hereinabove with respect to one bracket shall apply equally to its mirror-image.

Although the invention has been described with respect to a preferred embodiment, other modifications may be made without departing from the scope and spirit of the invention. Accordingly, it is to be understood that the invention is not to be limited by the specific illustrative embodiment, but only by the scope of the appended claims.

I claim:

1. A wall hanging assembly for a picture frame comprising:

a self locating picture frame corner bracket comprising a planar body portion defined in part by a lower edge and straight upper edge, said upper edge forming a corner with a straight outer edge, said outer edge forming an intersection with a lower edge, a part of which flares outwardly and downwardly to form a flange, said flange having a first lateral edge angularly spaced from said body portion to form a notch opening, said bracket including picture frame attachment means said upper edge providing alignment means for other adjacent picture frames; and, a wall track comprising an elongated web having an upturned lower end adapted to engage said bracket flange, said track including wall attachment means.

2. The assembly of claim 1 wherein said part comprises a major portion of the lower edge.

3. The assembly of claim 1 wherein said corner is square.

4. The assembly of claim 3 wherein said flange has a width at least equal to the width of said upturned lower end.

5. The assembly of claim 1 wherein said upturned lower end extends along the longitudinal extent of said web.

6. The assembly of claim 4 wherein said wall attachment means comprise spaced-apart openings extending through said web at predetermined locations along the longitudinal extent of said web.

7. The assembly of claim 6 wherein said picture frame attachment means comprise openings through said body portion.

8. The assembly of claim 3 wherein said bracket has a generally rectangular outline and said truck is J-shaped in cross-section.

9. The assembly of claim 1 including an inclined edge extending upwardly into said body portion from said lower edge to an intersection with said first lateral edge forming a notch corner in said body portion.

10. The assembly of claim 9 wherein said lateral edge is curved.

11. The assembly of claim 8 wherein said flange extends from said body portion at an angle of 130° or greater.

12. In combination:

a bracket having a square corner coextensively attached to the upper square corner of a picture frame to be hung on a wall, said bracket having a flat body with a lower edge having a flange that extends outwardly and downwardly from the picture frame, said flange having a first lateral edge angularly spaced from said flat body to form a notch opening, said bracket corner providing alignment means for other adjacent picture frames; and an elongated track attached horizontally to a wall location where said picture frame is to be hung, said track having a lower end inclined upwardly and outwardly to form a trough for cooperating engagement with the bracket flange.

13. The combination of claim 12 wherein said flange comprises a part of said lower edge.

14. The combination of claim 13 including an inclined edge that extends from said lower edge into said body portion to an intersection with said first lateral edge.

15. The combination of claim 14 wherein said lateral edge is curved.

16. The combination of claim 14 wherein said flange extends from said body portion at an angle of 130° or greater.

* * * * *